United States Patent [19]

Black

[11] 4,284,981

[45] Aug. 18, 1981

[54] SENSOR ALARM AND SUPPORT

[76] Inventor: Robert B. Black, 5110 Berkley Ct., Fort Wayne, Ind. 46815

[21] Appl. No.: 151,303

[22] Filed: May 19, 1980

[51] Int. Cl.[3] ..... G08B 21/00; A47F 5/00

[52] U.S. Cl. ..... 340/545; 248/214; 340/546; 340/693

[58] Field of Search ..... 340/545, 546, 693; 248/214, 215, 345.1; 49/70; 98/87; 116/100

[56] References Cited

U.S. PATENT DOCUMENTS

| | | | |
|---|---|---|---|
| 430,377 | 6/1890 | Condon | 248/345.1 |
| 956,437 | 4/1910 | Seeley | 98/87 |
| 2,975,491 | 3/1961 | Paul et al. | 248/215 |
| 3,261,010 | 7/1966 | Kardel | 340/546 |
| 3,270,333 | 8/1966 | Barber | 340/546 |
| 3,378,830 | 4/1968 | Patrick | 340/546 |
| 3,664,626 | 5/1972 | Sneller | 248/214 |
| 3,710,365 | 1/1973 | Barnes | 340/693 X |
| 3,720,937 | 3/1973 | Lang et al. | 340/546 X |
| 3,745,551 | 7/1973 | Smith | 340/546 |
| 3,798,627 | 3/1974 | Kaufman | 340/546 |
| 3,878,539 | 4/1975 | Gooding | 340/546 |
| 3,907,118 | 9/1975 | Pelavin | 248/345.1 X |
| 3,938,120 | 2/1976 | O'Connell | 340/546 X |
| 4,059,832 | 11/1977 | Conklin | 340/546 |
| 4,102,470 | 7/1978 | Timmons | 248/215 X |

*Primary Examiner*—John W. Caldwell, Sr.
*Assistant Examiner*—Daniel Myer
*Attorney, Agent, or Firm*—Richard T. Seeger

[57] ABSTRACT

A sensor alarm has a sensor for detecting heat, smoke, noxious gases, and the like and an alarm for warning of an alarm condition coupled to the sensor. The sensor alarm is attached to a support plate. An angled arm is formed at the upper edge of the plate to provide an inverted channel-shaped member fittable over a door top and having stiffly resilient pads for forcibly cocking the door top open, when the door is closed and latched, to provide a path for gaseous passage so that room occupants are provided with an early warning of an alarm condition.

8 Claims, 5 Drawing Figures

SENSOR ALARM AND SUPPORT

BACKGROUND OF THE INVENTION

1. Field of the Invention

This invention is in the field of sensor-alarm supports and more particularly to supports for portable alarms for early warning of smoke presence.

2. Description of the Prior Art

Sensor-alarms and supports for detection and warning of smoke presence to building and room occupants have long been known in the art. Recently, smoke alarms have enjoyed popularity due to their safety effectiveness in warning building occupants of smoke and fire in the building. These alarms, for the most part, are intended for permanent or semi-permanent installation in a home or building wherein there is air circulation so that one alarm provides warning for an entire building or area of several rooms. A need exists for an alarm that is capable of providing a warning in a closed room, or isolated room in a home, of fire and smoke conditions exteriorly of, as well as interiorly of, the room.

SUMMARY OF THE INVENTION

A support for a sensor-alarm, such as a smoke alarm, is provided for hanging on a door in a closed room, such as a motel or hotel room, that provides an air passage to the alarm for sensing smoke and fire exteriorly of the room, as well as interiorly of the room. The sensor and alarm are affixed to a mounting plate having an angle arm extending transversely from the top edge of the plate to form an inverted U-shaped member fittable over the top edge of a door. The angle arm has a transverse portion affixed to the plate at one edge and having a depending flange at the opposite edge. The transverse portion has a transverse slot formed centrally therein.

A pair of laterally spaced, stiffly resilient, pads are affixed to the outer side of the flange with the top edges of the pads being substantially flush with the top edge of the flange. The lateral space between the pads and the slot in the transverse portion are aligned and provide a gaseous passage to conduct smoke from one side of a closed door to the other side. The laterally outer edge of each pad is substantially flush, respectively, with the opposite lateral edges of the flange.

The mounting plate is hung over the top edge of the door at the corner of the door directly above the door latch. Thus, when the door is closed, the top edge of a pad will be compressed between the door and the door head and the side edge of that pad will be compressed between the door and the door jamb, cocking or propping the door open. The lateral spacing between the pads and transverse slot provide a path for smoke and the like at the door top between the room exterior and interior when the door is closed. This is particularly advantageous in a motel or hotel where the hallway may be smoke-filled but, due to the necessity for closing and locking room doors, room occupants, especially if sleeping, would not otherwise be aware of the dangerous smoke and fire condition. The sensor is positioned on the plate directly in the path thus formed to provide early detection of the smoke. Also, since the support is at door top level, where smoke first collects, an alarm is provided when smoke is just present. The support also may be hung over a drapery rod or on a wall hook.

A decorative cover, preferably brightly colored, is provided for removable attachment to the support to cover the sensor-alarm and which is removed before the support is placed over a door top edge. The cover may then be placed in a conspicuous place in a hotel or motel room as a reminder to remove the sensor-alarm from the door prior to departure. The cover is then replaced on the support to cover and protect the sensor-alarm during transit until next used.

The sensor-alarm may be used on right or left opening doors, since a pad is positioned on each lateral side of the flange, is compact for carrying in a suitcase, brief case, or the like, and is inexpensive in manufacture.

It is therefore an object of this invention to provide a sensor-alarm support that is mounted on a door that provides a passage for smoke and the like around the door when closed.

Another object is to provide a support of the previous object that is portable, compact, and removably attachable to the door.

A further object is to provide for the support a removable cover that protects the sensor-alarm in transit and provides a reminder to remove and pack the sensor-alarm when departing the premises.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
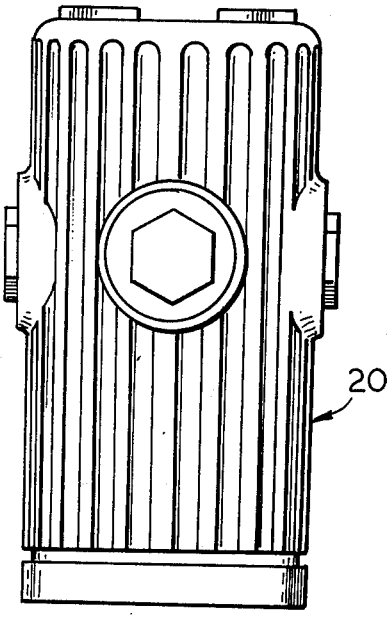
FIG. 1 is a front elevational view of the cover for the sensor-alarm support.

Referring to the drawing, elongated C-channel cover 20 is decoratively designed, and is preferably brightly colored, and of a plastic material. Adjacent the side edges of cover 20 are formed lands 22, 24, respectively, which face inwardly of the cover sides. Sensor-alarm 26, which is commercially available, has mounted near the upper edge thereof a sensor 28 for sensing smoke, heat, or other dangerous condition such as noxious gases, and emits an electrical signal upon sensing of such condition. An alarm 30 is mounted below sensor 28 and is coupled thereto to receive the sensed condition signal and emit an audible and/or visual alarm.

Sensor-alarm 26 is attached, as by adhesives or metallic fasteners such as tap bolts, to support 34 having elongated plate 36 and angle arm 38, having laterally spaced portions 40, 42 extending transversely from the upper edge of plate 36. Portions 40, 42 define a transverse slot 43 therebetween. Flange 44 depends from the distal edges of portions 40, 42 and is transversely spaced from plate 36 a distance approximately equal to the thickness of a door, whereby plate 36 and arm 38 form an inverted channel snugly fittable over the top edge of the door. Arm 38 may be transversely adjustable to plate 36, by means well known in the art, to accomodate different door thicknesses. A notch 46 is formed in the upper edge of flange 44 between portions 40, 42 for purposes later described. An opening 48 is formed centrally in flange 44 to receive a wall nail or hook.

Stiffly resilient bumper pads 50, 52 are attached, as by adhesive, in laterally spaced relation to the outer surface of flange 44. The lateral spacing is approximately equal to the length of notch 46. The top edges of pads 50 and 52 are substantially flush with the top edge of flange 44 and the outer side edge 54 of pad 50 is substantially flush with the outer side edge 56 of flange 44. The outer side edge 58 of pad 52 is substantially flush with the outer side edge 60 of flange 44, for purposes later described.

A removable cover 62 is provided in plate 36 and, when removed, provides access to a battery compartment in sensor-alarm 26 for installation and removal of batteries, not shown, that provide the power source for sensor 28 and alarm 30. Grooves 66, 68 are formed between sensor-alarm 26 and plate 36 for slidingly receiving lands 22, 24, respectively, of cover 20 and to retain cover 20 over sensor-alarm 26.

Figure 4:
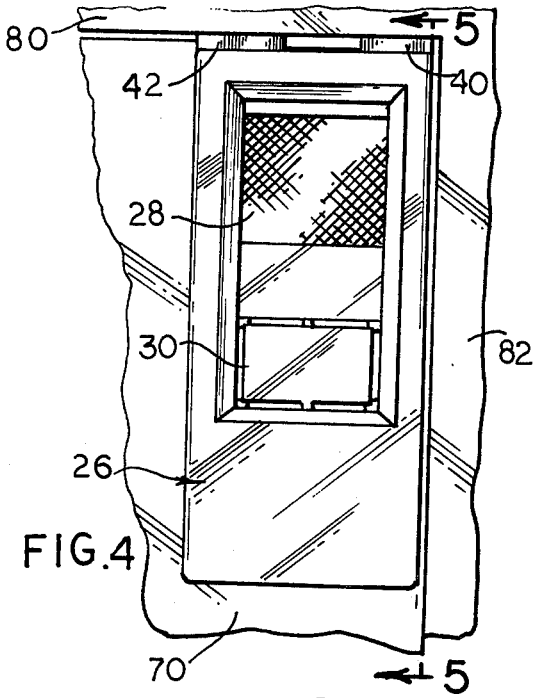
FIG. 4 is a front elevational view of a sensor-alarm and support mounted on a door, shown broken away.
Figure 2:
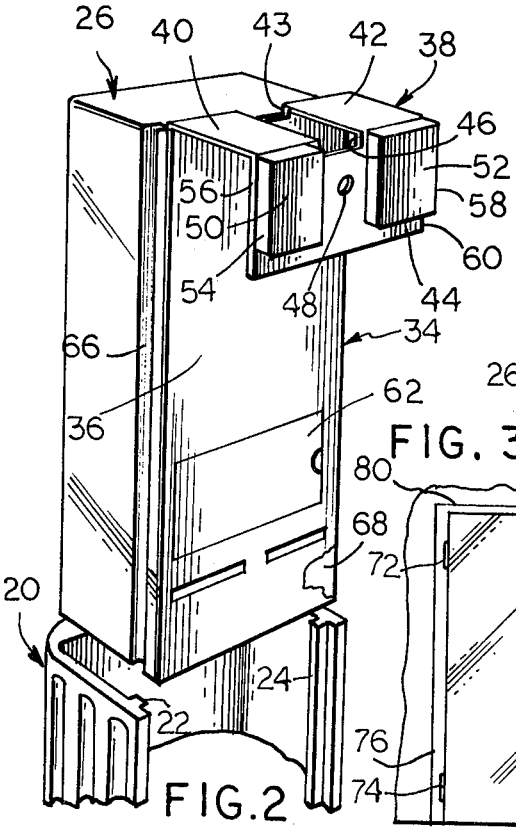
FIG. 2 is an exploded view in perspective of a preferred embodiment of this invention showing the cover, partially broken away, in removed position.
Figure 3:
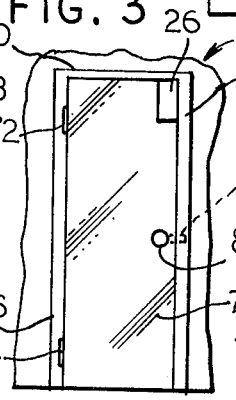
FIG. 3 is a front elevational view of a door having an embodiment of this invention mounted thereon.
Figure 5:
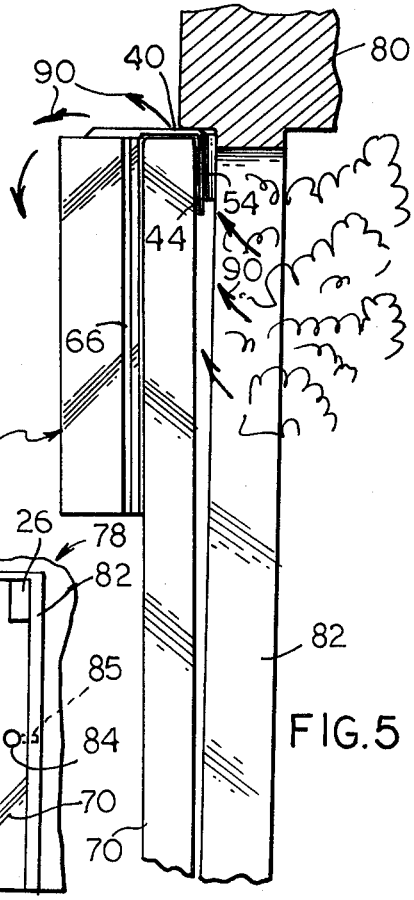
FIG. 5 is a slightly enlarged section taken at 5—5 of FIG. 4.

Referring to FIGS. 3–5, a door 70 is swingably mounted on hinges 72, 74 to the left door jamb 76 of door frame 78, having door head 80 and right door jamb 82. Door knob 84 is mounted in door 70 to release the door latch 85 when turned.

Sensor-alarm 26 is positioned in the upper right corner of door 70, as viewed in FIGS. 3 and 4, with angle arm 38 placed over the top edge of door 70 until portions 40, 42 abut the top edge of the door with plate 36 in slideable contact with one door side and flange 44 in slideable contact with the opposite door side. When door 70 is closed, the upper edges of pads 50, 52 contact door head 80 and the outer side edge of pad 52 contacts door jamb 82 as shown in FIGS. 3–5. This forcibly cocks the upper edge of door 70 slightly open, FIG. 5, providing for passage of air from the outside of door 70, or right side as viewed in FIG. 5, to the inside of door 70, as shown by arrows 90. If there were fire or smoke outside door 70, the attendant thermal convection and static pressure would cause air and smoke to flow as indicated by the arrow 90.

The flow is substantially aided and directed by the passage formed by the lateral spacing between pads 50, 52, notch 46, and the lateral spacing between portions 40, 42 to sensor 28, activating sensor-alarm 26. Thus, a passage directing smoke and heat flow to sensor 28 from the area outside closed door 70 is provided, insuring gaseous communication and providing early smoke warning, even though the door is latched and locked, as it normally would be in a motel or hotel room.

Support 34 would operate equally well if door 70 were hinged to jamb 82. In this instance, sensor-alarm 26 would be placed on the upper left corner of the door 70 and pad 52 would, in similar manner as pad 50 before, be positioned between door 70 and door head 80 and jamb 76 to forcibly cock door 70 open in its latched and locked position.

Cover 20 is removed when the sensor-alarm 26 is hung on door 70, and may be placed in a conspicuous position, such as on a dresser top or suitcase top, to remind the occupant to remove, cover, and pack sensor-alarm 26 before departing. Also, sensor-alarm 26 may be hung from a drapery or curtain rod, or from a wall nail or hook.

While there have been described above the principles of this invention in connection with specific apparatus, it is to be clearly understood that this description is made only by way of example and not as a limitation to the scope of the invention.

What is claimed is:

1. A sensor alarm support for use with a door mounted in a door frame having a door head and two door jambs and hinged on one door jamb to swing closed and latched against the other door jamb comprising:

a mounting plate;

one side of said plate adapted to have mounted thereon a sensor and an alarm coupled to said sensor;

an angle arm being affixed to the top edge of said plate and having a transverse portion extending transversely from the other side of said plate;

a flange depending from said transverse portion and being transversely spaced from and substantially parallel to said plate whereby said plate and arm form an inverted channel snugly fittable over the top door edge;

a stiffly resilient bumper pad being affixed to the outer side of said flange and being positioned on said flange so that the edges of said pad and an edge of said flange are substantially flush, whereby, when said door is in its latched position, a pad portion will be between a corresponding door edge and at least one of said door head and said other door jamb to forcibly cock said door open to provide a clearance for a gaseous path.

2. The apparatus of claim 1 wherein said pad is positioned on said flange so that a top and side edge of said pad are substantially flush with the top and a side edge of said flange, respectively.

3. The apparatus of claim 1 including a second stiffly resilient bumper pad affixed to said outer side of said flange in horizontally spaced relation to said first pad to define a transverse channel therebetween, said second bumper being positioned on said flange so that a top and side edge of said second pad are substantially flush with the top and a second side edge of said flange, respectively.

4. The apparatus of claim 3 wherein said transverse portion has a transverse slot formed therein extending from said plate to said flange and substantially aligned with said channel to provide a convection passage from one door side to the other door side for gases to be sensed.

5. The apparatus of claim 1 including a decorative protective cover removably attachable to said sensor-alarm support plate.

6. The apparatus of claim 1 having an opening formed in said plate for receiving a wall nail or hook.

7. The apparatus of claim 1 including a sensor, an alarm, and a power supply being mounted on said one side of said plate; said alarm being coupled to said sensor and said power supply and being energized to an alarm state upon sensing of an alarm condition by said sensor.

8. The apparatus of claim 4 including a sensor, an alarm, and a power supply being mounted on said one side of said plate; said alarm being coupled to said sensor and said power supply and being energized to an alarm state upon sensing of an alarm condition by said sensor; said sensor being positioned closely adjacent said convection passage to receive the gases to be sensed substantially immediately after the gases have departed said passage whereby improved sensitivity is obtained.

* * * * *